United States Patent [19]

Berrod et al.

[11] Patent Number: 4,925,588

[45] Date of Patent: May 15, 1990

[54] ANTISOILING AND ANTI-REDEPOSITION LATICES FOR THE AQUEOUS WASHING OF TEXTILE ARTICLES

[75] Inventors: Gerard Berrod, Villeurbanne; Dominique Charmot, Paris; Robert Gresser, Le Pont de Claix; Gilles Guerin, Sainte Foy les Lyon, all of France

[73] Assignee: Rhone-Poulenc Chimie, France

[21] Appl. No.: 137,232

[22] Filed: Dec. 23, 1987

[30] Foreign Application Priority Data

Dec. 24, 1986 [FR] France ..... 86 18471
May 20, 1987 [FR] France ..... 87 07279

[51] Int. Cl.[5] ..... C11D 3/37

[52] U.S. Cl. ..... 252/174.23; 252/8.6; 252/174.21; 252/174.24; 252/DIG. 15; 427/393.4; 525/167; 526/318.4

[58] Field of Search ..... 252/174.23, 174.24, 252/DIG. 2, DIG. 15, 174.21, 8.6; 526/318.4; 525/167; 427/393.4

[56] References Cited

U.S. PATENT DOCUMENTS 3,782,898 1/1974 Mandell, Jr. ..... 252/174.24
4,711,740 12/1987 Carter et al. ..... 252/DIG. 2

FOREIGN PATENT DOCUMENTS 201079 9/1986 Japan .
2104091 3/1983 United Kingdom ..... 252/174.24

*Primary Examiner*—Hoa Van Le
*Attorney, Agent, or Firm*—Finnegan, Henderson, Farabow, Garrett & Dunner

[57] ABSTRACT

Antisoiling and anti-redeposition latices which are usable in the aqueous washing of textile materials, consisting either of copolymers of vinyl acetate with unsaturated carboxylic acids, optionally grafted with sufonic polyesters, or of (meth)acrylic/unsaturated carboxylic acid copolymers grafted with polyester sulfonates.

11 Claims, No Drawings

ANTISOILING AND ANTI-REDEPOSITION LATICES FOR THE AQUEOUS WASHING OF TEXTILE ARTICLES

The present invention relates to latices which can be used as antisoiling and anti-redeposition agents for the aqueous washing of textile articles.

It is known that the detergent compositions currently marketed for the washing of synthetic or natural textile articles are complex mixtures of different products, all of which have well specified functions such as, for example, metal-complexing agents, surfactants, anticorrosion agents, detergents, anti-redeposition agents, bleaching agents or antisoiling agents.

Antisoiling agents essentially reduce the affinity of textile fibers for soilings, especially for greasy soilings, and thereby facilitate their removal.

Anti-redeposition agents essentially avoid the deposition of soiling on the textile fibers and especially avoid the redeposition of the soiling removed during washing.

The main subject of the invention consists of new agents having anti-redeposition and soiling-removal properties which are especially effective and relatively low in cost.

Another subject of the invention relates to washing compositions employing these new antisoiling agents.

In this text and throughout the remainder of the description, the term latex is used in its customary sense, i.e., to denote aqueous dispersions of solid polymers forming heterogeneous systems comprising an aqueous continuous phase and a solid discontinuous phase.

The alkali-soluble latices of the invention, which are the subject of the patent application, are in a dispersed state at a certain pH, in particular an acidic or neutral pH, and, when the pH is increased, undergo a disintegration of the abovementioned polymerized particles, thereby leading to aqueous solutions of polymers. In other words, the latices which are suitable in the context of the invention are those which, when the pH is increased, are capable of undergoing a change in their configuration dependent on the pH of the detergent bath.

The alkali-soluble latices of the general type here described are well-known products. Their preparation is considered to be well within the capability of the person of ordinary skill in the art.

However, it has been discovered that there is a series of latex compositions which can be synthesized at low cost, and which also have improved antisoiling and anti-redeposition properties relative to those of the latices described in the prior art.

The latices which are the subject of the present invention are all vinyl latices, composed of at least one copolymer of at least one vinyl ester with at least one unsaturated carboxylic acid, optionally grafted with at least one polyester sulfonate, or of at least one (meth)acrylic/unsaturated carboxylic acid copolymer grafted with at least one polyester sulfonate.

A first type of alkali-soluble latices which are very suitable in the context of the present invention includes latices based on vinyl esters. More especially, latices based on vinyl esters, ethylenically unsaturated mono- or dicarboxylic acids, and optionally, either at least one (meth)acrylic ester (differing, of course, from the specific vinyl ester(s) used) or at least one water-soluble comonomer, such as acrylamide or vinylsulfonate, can be used. Maleic, crotonic, (meth)acrylic and itaconic acids are preferred. Acrylic acid, when used, may be substituted by a methyl(meth)acrylic acid. In general, the content of acid (percentage by weight of acidic comonomer in the product) is at least 3%, and preferably ranges from 3 to 11%, more preferably 3 to 8%. Vinyl acetate is a preferred vinyl ester.

The first type of alkali-soluble latices which are the subject of the present invention also consists of the latices based on vinyl esters, described above, polymerized in the presence of polyester sulfonate.

A second type of alkali-soluble latices which are the subject of the present invention consists of at least one (meth)acrylic ester and at least one unsaturated carboxylic acid grafted with polyester sulfonates.

In the second type, latices based on (meth)acrylic esters, ethylenically unsaturated mono or dicarboxylic acids, and optionally, other monomers, such as styrene or butadiene, may be used.

Exemplary (meth)acrylic esters include alkyl (meth)acrylates in which the alkyl chain preferably contains 1 to 4 carbon atoms, such as methyl or ethyl (meth)acrylate.

Preferred acids for the second type of latices include (meth)acrylic, itaconic and maleic acids.

In principle, the content of acid (percentage by weight of comonomer in the product) in the second type of latex is at least 10% and generally ranges from 10% to 20%.

The content of polyester sulfonate with respect to the monomers is preferably less than 10%. The more preferred polyester sulfonates are those containing a distribution of phthalic or succinic acid with respect to ethylene oxide of approximately 60% by weight phthalic or succinic acid and 40% by weight of ethylene oxide groups. The distribution of the phthalic acid among its isomers is approximately as follows: 80% (by weight or moles) of terephthalic acid and 20% (by weight or moles) of isophthalic acid, the latter being almost completely sulfonated. For example, 15% by mole of sulfonated isophthalic acid may be used.

The latices of the present invention are preferably chosen from those of the first group of alkali-soluble latices, which have a composition which corresponds to the following distribution:

84 to 96% of vinyl acetate, 3 to 6% of acrylic or crotonic acid or acrylic acid substituted by a methyl (meth)acrylic acid, and 1 to 10% of polyester sulfonate.

It is preferable to use latices compositionally falling within the following limits:

vinyl acetate 87–94% crotonic or acrylic acid 4–5% polyester sulfonate 2–8%

Even more preferred are latices in which the acid is acrylic acid.

The above products which have undergone a partial or total hydrolysis of the vinyl acetate groups, that is to say a conversion of the vinyl acetate to vinyl alcohol, also form part of the invention.

Detergent compositions containing the latex described above also form part of the invention; they contain an amount of latex effective for improving the antisoiling and/or anti-redeposition properties of the detergent, preferably at least about 0.08%, more preferably at least 0.1% and still more preferably at least 0.4%, by weight of latex described above. On a ppm basis, it is preferred that the detergent compositions contain about 5–100 ppm of latex.

The detergent compositions can additionally contain typical washing additives, such as pyrophosphates, metaphosphates, alkali metal tripolyphosphates, zeolites, surfactants, a bleaching system, enzymes, optical brighteners, perfumes, silicates and the like.

The latex can also be incorporated in a rinsing composition, thereby, of course, enabling the latex to be added to the bath during rinsing.

Naturally, everything that has been stated above in the description relating to the nature and characteristics of the alkali-soluble latex applies here in relation to the detergent compositions, the latices participating in the constitution of the detergent being absolutely identical to those described above.

Examples will now be given. These Examples are for illustrative purposes only and in no way limit the invention.

The object of the tests used in the course of the examples which follow is to assess the antisoiling and anti-redeposition properties of a given additive.

The redeposition of soiling is a cumulative phenomenon which manifests itself by a graying of a cloth after a large number of washing cycles.

EXAMPLES 1 TO 4

To measure the anti-redeposition properties, the method used consists in washing samples of fabrics several times in the presence of the test additive and a soiled fabric. The experimental conditions are as follows:

Operating Conditions

Five cumulative washing cycles are performed according to the following conditions:

Washing temperature: 60° C.

Washing time: 20 min. (7 min. of temperature rise and 13 min at 60° C. The speed of agitation is 100 strokes/-min.)

Dilution: addition of 250 ml of cold hard water, followed by 5 min. of agitation 3–5 min. rinsing in the presence of 500 ml of cold hard water Water hardness (33° French scale: 330 mg $CaCO_3$/1)

Drying of the fabrics by passing them twice in succession through a photographic glazer Measurement of reflectance: GARDNER photometer filter Y, 4 thicknesses of fabric.

Fabrics

| | |
|---|---|
| Cotton 405<br>Polyester cotton (PE/C) 7406<br>Polyester "Dacron 54" (PE) | Source: TESTFABRIC |

Soiling

KREFELD WFK (Alderstrasse, 44, Lieferschein)

EMPA (COTTON Saint GALLEN EMPA, materials testing Laboratory: Unterstrasse 11, P.O. Box, CH 9001, ST. GALL).

Equipment

Tergotometer (HOBOKEN, N.J., United States Testing Co., Inc.) (2 pots per test)

each tergotometer pot contains:

4 cotton test specimens (10×12 cm)

4 PE/C test specimens (10×12 cm)

4 polyester test specimens (10×12 cm)

4 KREFELD-soiled cotton test specimens (10×12 cm) or:

4 KREFELD-soiled cotton test specimens and 2 EMPA-soiled cotton test specimens (10×12 cm)

500 ml of detergent solution (the detergent concentration is 6 g/l)

Bath ratio 1:25

Assessment of Performance

The measurement of reflectance $R_y$ is performed using a GARDNER photometer, filter y, on 4 thicknesses of fabric. The more effective the additive, the greater the reflectance of the fabric washed 5 times in its presence, according to the test described above, and the more closely this reflectance approaches that of the clean fabric ($R_y$=83%). The test products are especially active on synthetic fibers, and also on mixed fibers. The reflection measurements shown in the tables set forth below relate exclusively to the polyester fabrics.

Results of the Tests

We studied the influence of the following parameters on the anti-redeposition efficiency of the products:

the nature of and content of the acid;

the content of sulfonated polyester; and the hydrolysis of acetate groups.

In the tables below, the contents of the vinyl acetate, crotonic or acrylic acid and sulfonated polyester constituents are expressed as percentages by weight. The performance of the best additives are compared with those of the commercial additive F4M (DOW CHEMICAL cellulose ether).

The composition by weight of the detergent formula used is as follows:

| | |
|---|---|
| Sodium alkylbenzenesulfonate | 7% |
| Sodium stearate | 3% |
| Cemulsol$^R$ DB 6/18 | 2.5% |
| Cemulsol$^R$ LA 90 | 2.5% |
| Sodium tripolyphosphate | 28.75% |
| Sodium pyrophosphate | 2% |
| Sodium orthophosphate | 0.5% |
| Sodium disilicate | 9.35% |
| Sodium sulfate | 17.5% |
| Tinopal ® SOP | 0.2% |
| Tinopal ® DMS X | 0.2% |
| Esperase enzyme, Novo | 0.3% |
| Sodium perborate | 25% |
| Magilex ® 120 | 1% |
| Sodium EDTA | 0.2% |

EXAMPLE 1

Performance of different latices of the first type

The products noted in Table I are introduced in the form of a post-addition; the detergent concentration is 6 g/l, containing 0.42% of additive. Each sample of fabric is washed 5 times in the presence of the soiling.

TABLE I

| Product | % vinyl acetate | COMPOSITION % crotonic acid | % acrylic acid | polyester-sulfonates | PERFORMANCE Reflectance $R_y$ (polyester) |
|---|---|---|---|---|---|
| Blank | | | | | 58 |
| F4M | | | | | 77.5 |
| 1 | 95.50 | 3.50 | — | 1 | 76 |

TABLE I-continued

| Product | % vinyl acetate | COMPOSITION % crotonic acid | % acrylic acid | polyester-sulfonates | PERFORMANCE Reflectance $R_y$ (polyester) |
|---|---|---|---|---|---|
| 2 | 93.10 | 4.90 | — | 2 | 78 |
| 3 | 91.35 | 4.80 | — | 3.85 | 78.5 |
| 4 | 88 | 4.60 | — | 7.40 | 78 |
| 5 | 92.30 | — | 3.85 | 3.85 | 78 |
| 6 | 91.35 | — | 4.80 | 3.85 | 78 |
| 7 | 88 | | 4.60 | 7.40 | 77 |

The blank reference test corresponds to five washings of fabrics in the presence of soiling and in the absence of additive.

EXAMPLE 2

This Example represents a study in terms of the concentration in the detergent. In conformity with Example 1, different tests are carried out by modifying the concentration of additive in the detergent bath.

post-addition introduction at different concentrations detergent concentration 6 g/l KREFELD soiling.

TABLE II

| PRODUCT | PERFORMANCE $R_y$ (polyester) | | |
|---|---|---|---|
| conc. in the bath<br>conc. in the formula | 5 ppm<br>(0.08%) | 10 ppm<br>(0.17%) | 25 ppm<br>(0.42%) |
| 5 | 72 | 77 | 78 |
| 7 | 73 | 76.5 | 77 |
| F4M | 75 | 76 | 77 |
| Blank | | 58 | |

EXAMPLE 3

A study of the influence of the nature of the soiling was undertaken. The following conditions were employed:

post-addition introduction of the latex at a constant concentration in the bath=25 ppm detergent concentration 6 g/l KREFELD+EMPA soilings

TABLE III

| PRODUCT | $R_y$ polyester |
|---|---|
| — | 65 |
| F4M | 45 |
| 5 | 77 |
| 7 | 78 |

With the mixture of soilings, the cellulose ether undesirably enhances redeposition, whereas, in contrast, the claimed additives remain effective.

EXAMPLE 4

The additive product 5 (as defined in Table I above) was introduced into a thick mixture for spraying (slurry).

In a slurry, alkaline pH, ionic strength and high temperature tend to degrade delicate products; consequently, the detergent obtained from a slurry containing the additive was tested.

The usual ingredients of a detergent, such as TPP, ionic surfactants, sodium silicate, sodium sulfate and water are mixed to form a thick mixture which constitutes the slurry. This highly alkaline mixture is then dried by spraying to obtain a powder. Nonionic surfactants, bleaching agents, enzymes and perfumes are then added.

Two slurries were prepared: the additive product 5 is added to one of the slurries. To simulate the hydration of TPP and the spraying, these mixtures are maintained for 1 h 30 min at 90° C. with stirring. Under these pH and temperature conditions, the additive product 5 is completely hydrolyzed; the vinyl acetate groups are converted to vinyl alcohol. Three formulae having the same overall composition as above—see the formula set forth above immediately prior to "Example 1"—were prepared from the slurries and tested under experimental conditions identical to those described in Example 1.

The characteristics of the formulae prepared are as follows:

formula X: prepared from the control slurry without additive.

formula Y: prepared from the control slurry without additive; the additive product 5 is introduced in the form of a post-addition in the proportion of 0.42% of the formula.

formula Z: prepared from the slurry containing the additive product 5; the percentage by weight of additive product 5 in the formula is 0.42%.

The reflectance values $R_y$ of the dacron fabric obtained with these formulae are recorded in Table IV below:

TABLE IV

Anti-redeposition properties of the additive product 5 introduced into a slurry:

| DETERGENT FORMULA | $R_y$ |
|---|---|
| X: without additive | 54 |
| Y: post-addition introduction of additive (0.42%) | 78 |
| Z: additive added to the slurry (0.42%) | 80.5 |

The results obtained with the additive product 5 introduced in a slurry are of the same order of magnitude as those obtained when this additive is introduced into the detergent bath. Consequently, it can be concluded that the product retains its anti-redeposition properties when it is introduced in a slurry. This example illustrates that, after hydrolysis, the polymers of the invention retain their anti-redeposition activity.

EXAMPLES 5 AND 6

To measure the antisoiling properties, the method used consists in washing samples of fabrics in the presence of the test additive, in depositing stains on these fabrics and in washing them again. The results obtained reflect the affinity for a soiling of the textiles conditioned in this manner. The experimental conditions are as follows:

Fabrics

| | |
|---|---|
| Cotton 405<br>Polyester cotton (PE/C) 7404<br>Polyester "Dacron 54" (PE) | Source: TESTFABRIC |

Equipment

HANAU Linitest (2 pots per test)

Each Linitest pot contains:

10 stainless steel balls 12 mm in diameter 4 cotton rectangles (10×12 cm) equivalent to
4 PE/C rectangles (10×12 cm), 20 g of fabric
4 polyester rectangles (10×12 cm)
300 ml of detergent solution
Bath ratio 1:15.

Operating Conditions

Washing temperature: 60° C.
Washing time: 40 min (25 min of temperature rise and 15 min at 60° C.)
Dilution: addition of 150 ml of cold hard water followed by 5 min of agitation
3 5-min rinsings in the presence of 400 ml of cold hard water
Water hardness (33° TH)
Drying of the fabrics by passing them twice in succession through a photographic glazer
Measurement reflectance of: GARDNER photometer filter Y, 4 thicknesses of fabric.

Soiling

Automobile sump oil.

Operating Procedure

Conditioning: a washing cycle is performed in the presence of the test additive. The additive can be introduced either into the detergent bath or during rinsing.
Staining: using a burette, 4 drops of sump oil are deposited at the center of the sample of fabric, arranged on a watch-glass. The fabrics are then placed in the oven at 60° C. for one hour. One half of the samples are soiled in this manner.
Measurement of the reflectance of the stained fabrics (GARDNER, filter Y).
Washing: the procedure is the same as for the conditioning, but in the absence of additive. Each Linitest pot thus contains two stained samples and two unstained samples of each grade of fabric.
Measurement of the reflectance after washing (GARDNER, filter Y). The reflectance of the stained fabrics indicates the antisoiling effect.

Expression of the Results

The results relating to the removal of the soiling are expressed in the form of the "recovery" value R:

$$R\ \%: \frac{R_1 - R_s \times 100}{R_0 - R_s}$$

$R_s$=reflectance of the soiled fabric before washing,
$R_0$=reflectance of the unsoiled fabric before washing,
$R_1$=reflectance of the soiled fabric after washing.

The higher the recovery R, the greater the efficiency of the additive as an antisoiling agent.

EXAMPLE 5

This example illustrates the use of different latices whose characteristics are given in Tables V and VI.

TABLE V (type 1 latex)

| Product | COMPOSITION (%) % vinyl acetate | % crotonic acid | % other products |
|---|---|---|---|
| Blank | — | — | — |
| F4M | — | — | — |
| L 8 | 84.5 | 5.5 | Butyl acrylate 10 |

TABLE V-continued (type 1 latex)

| Product | COMPOSITION (%) % vinyl acetate | % crotonic acid | % other products |
|---|---|---|---|
| L 9 | 89.5 | 10.5 | — |
| L 10 | 91.8 | 2.2 | Itaconic acid 6 |
| L 11 | 91 | 5 | Acrylamide 4 |
| L 12 | 91 | 5 | Vinyl sulfonate 4 |
| L 13 | 91 | 5 | Acrylic acid 4 |
| L 14 | 91 | 5 | Maleic acid 4 |
| L 15 | 83.5 | 6.5 | Butyl acrylate 10 |
| L 16 | 95 | 5 | — |

TABLE VI (type 2 latex)

| Reference | Nature of the monomore | Percentage by weight of monomer in the product |
|---|---|---|
| L 17 | Butyl acrylate | 34.5 |
| | Methyl methacrylate | 32.5 |
| | Ethyl acrylate | 16.5 |
| | Methacrylic acid polymerized in the presence of 4% of sulfonated polyester | 16.5 |
| L 18 | Butyl acrylate | 34.5 |
| | Methyl methacrylate | 32.5 |
| | Ethyl acrylate | 16.5 |
| | Methacrylic acid polymerized in the presence of 8% of sulfonated polyester | 16.5 |

During the tests, the products are added to the medium at a pH such that they remain in suspension form (addition at the third rinsing). The solubilization of the latex takes place only at the subsequent washing (in which the pH increaes).

The composition of the formula used is as follows:

| | |
|---|---|
| TPP | 21.5% |
| Neutral pyrophosphate | 2% |
| Anhydrous neutral trisodium phosphate | 0.5% |
| 3Na silicate ($Na_2SiO_3$) | 8.6% |
| 3Na stearate ($CH_3$—$(CH_2)_{16}COONa$) | 3.0% |
| TINOPAL DMSX ® | 0.2% |
| TINOPAL SOP ® | 0.2% |
| ESPERASE NOVO ® | 0.3% |
| Perborate (Liquid air) | 25.0% |
| EDTA | 0.2% |
| Neutral LABS | 7.0% |
| CEMULSOL 6/18 ® | 2.5% |
| CEMULSOL LA 90 ® | 2.5% |
| Na sulfate | 24% |

During each group of tests, the test products (one to three) are compared with a test in the absence of additive. The results obtained are given in the following table:

| Detergent concent. | Additive and concentration in the bath | Recovery R % PE/C | PE | Observations |
|---|---|---|---|---|
| | none | 46.5 | 10.9 | |
| 7.5 g/l | latex $L_8$ 100 100 ppm | 47.0 | 13.5 | added at the 3rd rinsing |
| | none | 42.9 | 14.8 | |
| 7.5 g/l | latex $L_{12}$ 100 ppm | 56.8 | 18.7 | added at the 3rd rinsing |
| | latex $L_{13}$ 100 ppm | 60.1 | 23.7 | |
| | latex $L_{14}$ 100 ppm | 60.6 | 25.8 | added at the 3rd rinsing |
| | none | 47.1 | 12.1 | |
| 7.5 g/l | latex $L_9$ 100 ppm | 56.6 | 20.5 | added at the 3rd rinsing |
| | latex $L_{10}$ 100 ppm | 61.3 | 24.2 | |
| | latex $L_{11}$ 100 ppm | 56.6 | 21.0 | added at the 3rd rinsing |
| | none | 35.3 | 7 | |
| 7.5 g/l | latex $L_8$ 100 ppm | 48.5 | 26.6 | added at the 3rd rinsing |

The results confrim the antisoiling effect of the different test alkali-soluble latices.

EXAMPLE 6

This example illustrates the use of a few alkali-soluble latices at variable concentrations. The experimental conditions are the same as for Example 5. The results obtained are recorded in the following table:

| Detergent concent. | Additive and concentration in the bath | Recovery R % PE/C | PE | Observations |
|---|---|---|---|---|
| | none | 34.8 | 14.8 | |
| 7.5 g/l | latex $L_{14}$ 20 ppm | 46.5 | 16.6 | added at the 3rd rinsing |
| | none | 35.9 | 13.1 | |
| 7.5 g/l | latex $L_{14}$ 40 ppm | 40.3 | 17.8 | added at the 3rd rinsing |
| | none | 27.8 | | |
| 7.5 g/l | latex $L_4$ 60 ppm | 39.0 | | added at the 3rd rinsing |
| | none | 34.0 | 13.8 | |
| 7.5 g/l | latex $L_4$ 80 ppm | 45.5 | 18.1 | added at the 3rd rinsing |
| | none | 35.6 | 17.9 | |
| 7.5 g/l | latex $L_{13}$ 40 ppm | 43.6 | 23.6 | added at the 3rd rinsing |

These results confirm the antisoiling effect of the alkali-soluble latices for several additive concentrations.

EXAMPLE 7

The object of the test used in the course of the examples which follow is to assess the anti-redeposition properties of a given additive.

The method used consists in washing samples of fabrics in the presence of the test additive and of soiling deposited on cotton rovings. The results obtained reflect the affinity of the textiles conditioned in this manner for a soiling. The experimental conditions are as follows:

Fabrics

| | |
|---|---|
| Cotton 405<br>Polyester cotton (PE/C) 7404<br>Polyester "Dacron 54" (PE) | Source: TESTFABRIC |

Equipment

HANAU Linitest (2 pots per test) (automated tergotometer)

Each Linitest pot contains:

10 stainless steel balls 12 mm in diameter
4 cotton rectangles (10×12 cm) equivalent to
4 PE/C rectangles (10×12 cm), 20 g of fabric
4 polyester rectangles (10×12 cm)
300 ml of detergent solution
Bath ratio 1:15.

Operating Conditions

Washing temperature: 60° C.
Washing time: 40 min (25 min of temperature rise and 15 min at 60° C.)
Dilution: addition of 150 ml of cold hard water followed by 5 min of agitation
3 5-min rinsings in the presence of 400 ml of cold hard water
Water hardness (33° TH)
Drying of the fabrics by passing them twice in succession through a photographic glazer
Measurement reflectance of: GARDNER photometer filter Y, 4 thicknesses of fabric.

Soiling

"Spangler" (sebum+particles)

Operating Procedure

Conditioning: a washing cycle is performed in the presence of the test additive and a soiling impregnated on cotton rovings. The additive can be introduced either into the detergent bath or during rinsing.
Measurement of the reflectance of the stained fabrics (GARDNER, filter Y).
Washing: the procedure is the same as for the conditioning but in the absence of additive. Each Linitest pot thus contains two stained samples and two unstained samples of each grade of fabric.
Measurement of the reflectance after washing (GARDNER, filter Y). The reflectance of the stained fabrics indicates the anti-redeposition effect.

Expression of the Results

The results relating to the anti-redeposition of the soiling are expressed in the form of the value of the difference delta R in reflectance before and after washing, and the efficiency E:

$$\text{DELTA } R: R_o - R_2: E\,\%: \frac{R_2 - R_1 \times 100}{R_o - R_1}$$

$R_2$=reflectance of the soiled fabrics after washing,
$R_0$=reflectance of the fabric before washing,
$R_1$=reflectance of the unwashed blank fabric.

The lower the recovery delta R, the greater the efficiency of the additive as an anti-redeposition agent.

The object of this example is to demonstrate the anti-redeposition effect of an alkali-soluble latex in the presence of a formula in which the builder or washing assistant consists of tripolyphosphate (TPP) and zeolite 4A.

The composition of the formula used is as follows:

| | |
|---|---|
| TPP | 19.0% |
| Zeolite | 17.0% |
| Na sulfate | 9.5% |
| Neutral pyrophosphate | 2.0% |
| Anhydrous $Na_3PO_4$ | 0.5% |
| 3Na silicate ($Na_2SiO_3$) | 8.6% |
| BLANOSE BWS | 1.5% |
| TINOPAL DMSX ® | 0.2% |
| TINOPAL SOD ® | 0.2% |
| ESPERASE NOVO ® | 0.3% |
| Perborate | 25.0% |
| Na stearate | 3.0% |
| LABS | 7.0% |
| CEMULSOL 6/18 ® | 2.5% |
| CEMULSOL LA 90 ® | 2.5% |
| EDTA | 0.2% |
| $H_20$ | 1.0% |

This example illustrates the use of different latices at a concentration of 100 ppm in a detergent formula having a bath concentration of 6 g/l.

| | Polyester/cotton | | Polyester | |
|---|---|---|---|---|
| Additive | Delta R | E % | Delta R | E % |
| none | 20 | — | 36 | |
| $L_9$ | 11 | 36 | 21 | 38 |
| | 19 | 28 | 24 | 38 |
| $L_{10}$ | 13 | 41 | 24 | 36 |
| $L_{11}$ | 0 | 100 | 1 | 97 |
| | 0 | 100 | 4 | 90 |
| $L_{12}$ | 5 | 73 | 11 | 66 |
| | 9 | 65 | 16 | 59 |
| $L_{13}$ | −1 | 106 | 1 | 97 |
| | 0 | 100 | 1 | 97 |
| $L_{14}$ | 1 | 94 | 1 | 97 |
| | 12 | 54 | 20 | 49 |
| $L_{15}$ | 6 | 73 | 16 | 59 |
| | 1 | 94 | 4 | 87 |
| $L_{16}$ | 5 | 69 | 1 | 97 |
| | −1 | 106 | 0 | 100 |

-continued

| | Polyester/cotton | | Polyester | |
|---|---|---|---|---|
| Additive | Delta R | E % | Delta R | E % |
| $L_{17}$ | −1 | 104 | 7 | 82 |
| $L_{18}$ | −1 | 104 | 3 | 91 |

We claim:

1. A method of improving the antisoiling or antiredeposition properties of a detergent composition comprising the step of adding to said detergent an amount of a latex which comprises a vinyl copolymer of at least one (meth)acrylic ester and at least one unsaturated carboxylic acid grafted with at least 1% polyester sulfonate effective for improving the antisoiling and antiredeposition properties of said detergent.

2. The method of claim 1 comprising at least 0.1% by weight of the latex.

3. The method of claim 2, wherein said vinyl copolymer is a copolymer of at least one (meth)acrylic ester and at least one unsaturated carboxylic acid selected from (meth)acrylic, itaconic and maleic acids.

4. The method of claim 3, wherein said (meth)acrylic ester is selected from esters wherein the alkyl chain contains 1 to 4 carbon atoms.

5. The method of claim 3, wherein said (meth)acrylic ester is selected from methyl(meth)acrylate and ethyl(meth)acrylate.

6. The method of claim 3, wherein said vinyl copolymer is grafted with at most 10% of polyester sulfonate.

7. The method of claim 6, wherein said polyester sulfonate contains a distribution of phthalic or succinic acid with respect to ethylene oxide of about 60% by weight of phthalic or succinic acid for 40% by weight of ethylene oxide.

8. The method of claim 1 comprising at least 0.2% by weight of the latex.

9. The method of claim 1 comprising at least 0.4% by weight of the latex.

10. The method of claim 2, wherein the percent by weight of acid comonomer ranges from 3 to 8%.

11. The method of claim 1, wherein the percent by weight of the carboxylic acid comonomer ranges from about 10 to 20%.

* * * * *